US006698531B2

(12) United States Patent
Kürten

(10) Patent No.: US 6,698,531 B2
(45) Date of Patent: Mar. 2, 2004

(54) VIBRATION TAMPER

(75) Inventor: Hans-Werner Kürten, Gödenroth (DE)

(73) Assignee: Bomag GmbH & Co., oHG, Boppard (DE)

( * ) Notice: Subject to any disclaimer, the term of this patent is extended or adjusted under 35 U.S.C. 154(b) by 0 days.

(21) Appl. No.: 10/109,192

(22) Filed: Mar. 27, 2002

(65) Prior Publication Data

US 2002/0141825 A1 Oct. 3, 2002

(30) Foreign Application Priority Data

Mar. 30, 2001 (DE) ..... 201 05 768 U

(51) Int. Cl.[7] ..... E01C 19/00

(52) U.S. Cl. ..... 173/113; 173/118; 404/133.05; 404/133.1; 123/198 E; 123/195 C; 123/195 S; 123/195 R

(58) Field of Search ..... 173/113, 118, 173/217; 404/133.05, 133.1, 133.2; 123/198 E, 195 C, 195 S, 195 R

(56) References Cited

U.S. PATENT DOCUMENTS

| | | | | | |
|---|---|---|---|---|---|
| 3,603,224 | A | * | 9/1971 | Dresher | 404/133.1 |
| 3,832,080 | A | * | 8/1974 | Stoecker | 404/133.1 |
| 4,015,909 | A | * | 4/1977 | Yamamoto | 404/133.1 |
| 4,071,009 | A | * | 1/1978 | Kraina | 123/198 E |
| 4,186,197 | A | * | 1/1980 | Tetsuo | 404/133.1 |
| 4,253,816 | A | * | 3/1981 | Tobias et al. | 425/385 |
| 5,199,389 | A | * | 4/1993 | Wolf et al. | 123/41.7 |
| 5,211,144 | A | * | 5/1993 | Collins et al. | 123/198 E |
| 5,269,265 | A | * | 12/1993 | Pretzsch et al. | 123/41.56 |
| 5,285,751 | A | * | 2/1994 | Liegeois et al. | 123/41.63 |
| 5,340,233 | A | * | 8/1994 | Motl | 404/133.05 |
| 5,419,404 | A | * | 5/1995 | Niemi et al. | 173/171 |
| 5,595,153 | A | * | 1/1997 | Hoppner et al. | 123/198 E |
| 5,672,027 | A | * | 9/1997 | Wadensten | 404/133.05 |
| 5,692,467 | A | * | 12/1997 | Sahm et al. | 123/198 E |
| 5,705,917 | A | * | 1/1998 | Scott et al. | 322/46 |
| 5,718,303 | A | * | 2/1998 | Ogasawara et al. | 180/69.21 |
| 6,000,879 | A | * | 12/1999 | Greppmair | 404/133.1 |
| 6,019,179 | A | * | 2/2000 | Zurbes | 173/49 |
| 6,112,831 | A | * | 9/2000 | Gustafsson | 173/162.2 |
| 6,390,034 | B1 | * | 5/2002 | Orzal et al. | 123/73 AD |
| 6,474,290 | B1 | * | 11/2002 | Coffey et al. | 123/198 E |

FOREIGN PATENT DOCUMENTS

| | | | |
|---|---|---|---|
| DE | 4433243 | A1 | 3/1996 |
| DE | 29801032 | U1 | 4/1998 |
| DE | 29805355 | U1 | 6/1998 |
| DE | 29920177 | U1 | 2/2000 |
| WO | WO 98/48119 | A1 | 10/1998 |

OTHER PUBLICATIONS

R. Sonnenberg, Vibrationsstampfer–Meister der Verdichtung, tis pp. 10–14 (Jul. 2000).

Roman Berger, Verdichtung mit voller Dynamik, Hoch & Tiefbau, pp. 24–27 (May, 2000).

* cited by examiner

*Primary Examiner*—Rinaldi I. Rada
*Assistant Examiner*—Gloria R Weeks
(74) *Attorney, Agent, or Firm*—Baker & Hostetler LLP

(57) ABSTRACT

A hand-guided vibration tamper, which is driven by a motor laterally cantilevered on the tamper head, is provided with guard plates covering its underside and lateral sides. The underside and lateral guard plates are connected to a housing for the motor, and the underside guard plate is fastened near its free end to the motor and/or an air circulation hood for the motor. Preferably, the underside guard plate is a thick-walled aluminum plate screwed together with the lateral guard plates and extends beyond to protect the air circulation hood with its extension. Advantageously, the motor is also protected by a substantially closed, upper covering connected to the lateral guard plates.

13 Claims, 4 Drawing Sheets

VIBRATION TAMPER

BACKGROUND OF THE INVENTION

The invention concerns a hand-guided vibration tamper, which is driven by a motor laterally cantilevered on the tamper head, wherein the motor is covered below and laterally by guard plates.

It is usual with such vibration tampers to position the drive motor in back beneath the guide fork and to protect it by side and/or floor plates from mechanical effects from the outside. The impetus for these protective measures is, first of all, the desire to use the tamper even in narrow pits, where laterally adjacent earth could damage the motor or its component parts. Moreover, a tamper can tip over from its standing position, or it must be transported lying on a loading bed, and in these two cases there likewise exists the danger of damage.

BRIEF SUMMARY OF THE INVENTION

Underlying the present invention is the objective of amplifying the protection of the motor and optionally its component parts. Here, the costs and the weight of these protective measures should not accumulate unfavorably.

This objective is accomplished in accordance with the invention in that lower (underside) and lateral guard plates are connected with a housing and in that the lower guard plate, near its free end, is secured on an air circulation hood of the motor and/or on the motor itself.

By connection of the guard plate and securing on the motor or on the air circulation hood, there results a substantially more stable protection of the motor and its component parts than with previously known constructions. Here, the guard plates themselves need not be constructed more massively than previously, so that the weight and the cost expenditure of the tamper do not rise owing to the measures of the invention.

The connection of the lateral guard plate with the lower guard plate can be realized by one-piece construction of all guard plates. Generally, however, it is more advantageous to work with separate parts, which are either connected form-locking with one another by hooking, or are screwed together. In this way, it is easier, for example, to possibly remove only one guard plate, in order to clean or repair an attached part of the motor situated behind it.

It is especially advantageous if the lower guard plate which, by being fastened on the motor and/or on the air circulation hood, functions almost as a carrier for the two lateral guard plates, is as thick-walled aluminum plates. Its load carrying capacity is thereby substantially increased without the weight increasing in comparison with a steel plate.

Moreover, it is recommended in this connection that the lower guard plate be contoured once or more, especially bilaterally, preferably bent up. Its bending strength is thereby significantly increased.

A further refinement of the invention consists in not allowing the two lateral guard plates to run out freely on their upper edges, but rather to connect them with a common upper covering of the motor. In this way, there results not only a better bracing of the lateral guard plates, but in addition also a protection of the motor against contamination, especially if the upper covering is, in contrast to the lateral guard plates, not perforated, but is substantially closed.

Finally it is recommended that at least one of the side plates extend up to about the level of the carburetor or the muffler of the motor. In this way, these component parts are also reliably protected against outside influences. In addition, the actuation elements for the carburetor can also be moved behind a suitably lengthened side plate, so that they are not deformed by outside effects.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
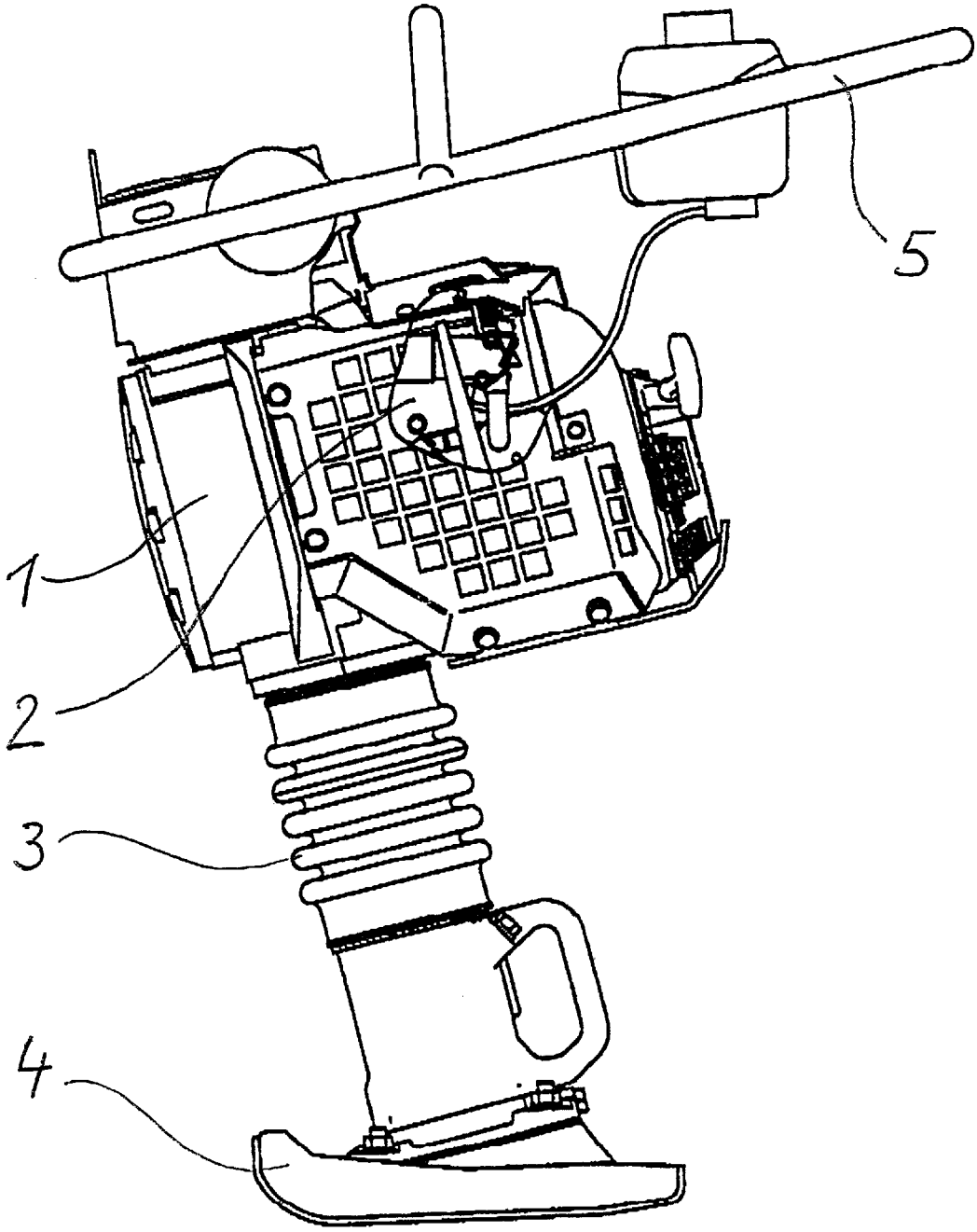
FIG. 1 is a side elevation view of a tamper according to the invention.

The tamper represented in FIG. 1 has an essentially known construction, namely a tamper head 1 on whose back, i.e., opposite the direction of operation, a drive motor 2 is cantilevered with the usual accessory apparatus, especially carburetor, exhaust, ignition, etc. At the bottom the tamping foot 4 is attached via an elastic bellows 3 and a connecting rod (not shown) of the tamping foot 4. This tamping foot 4 is set into approximately vertical vibrations of about 10 Hz by the drive motor 2 in a known manner, as a result of which the tamper jumps up several centimeters in each case, and brings about the desired compacting of the ground by its force of reaction.

A guide fork 5, by which the operator guides the tamper, is mounted at the upper end of the tamper head 1 via elastic damper elements.

Figure 2:
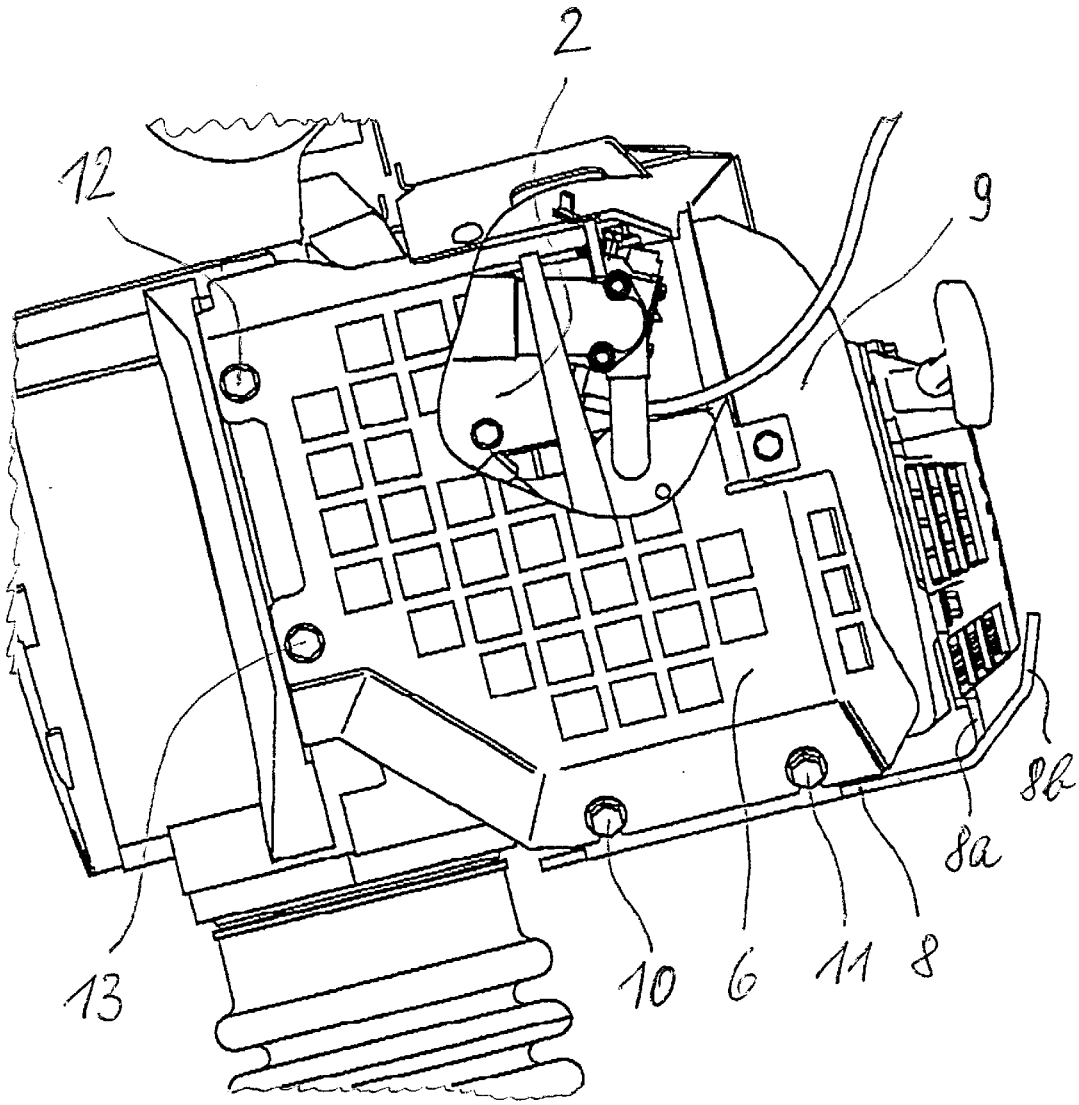
FIG. 2 is an enlarged side view of the drive motor of FIG. 1 without tamper and guide fork.
Figure 4:
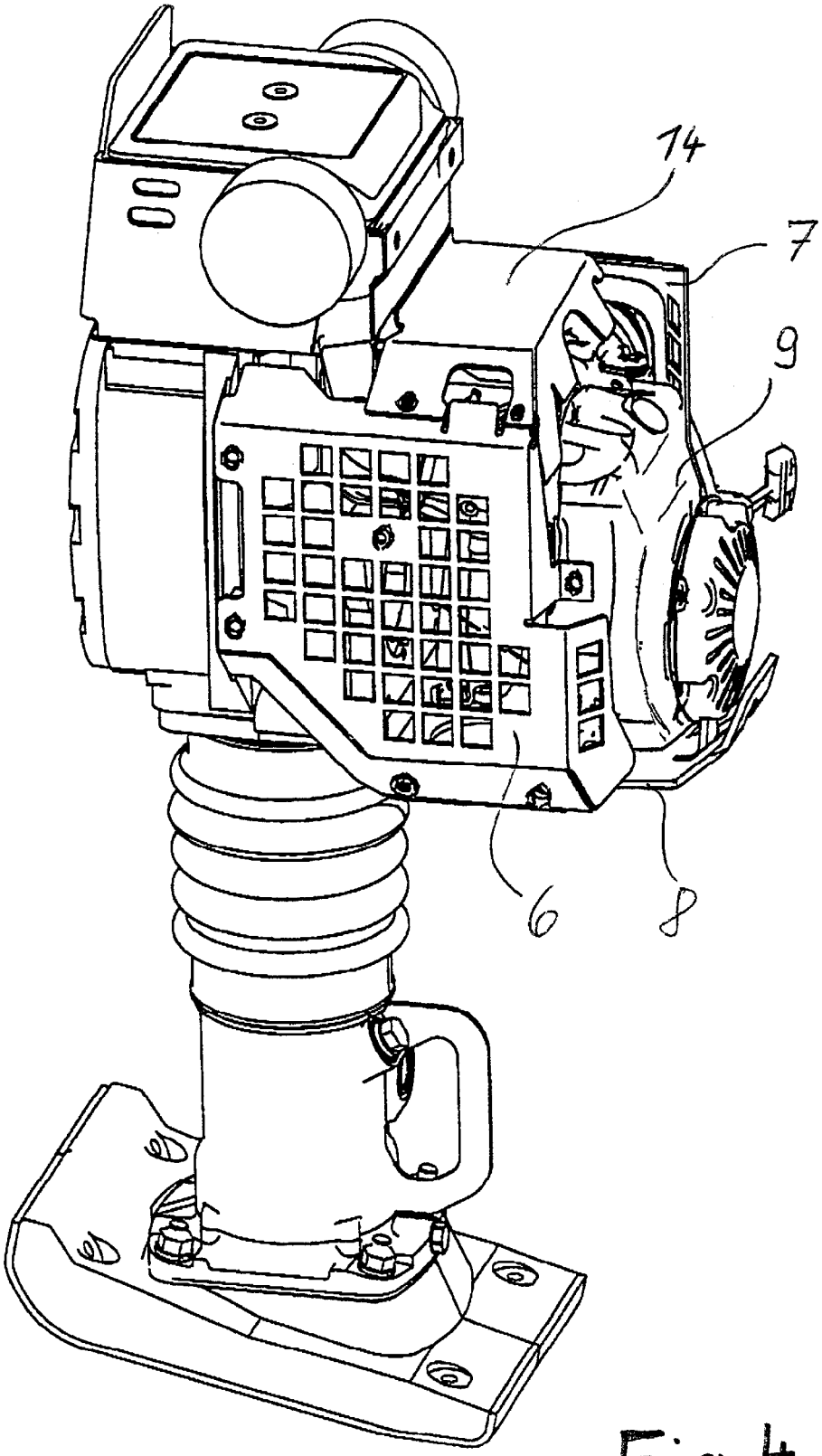
FIG. 4 is an oblique perspective view of the tamper of FIG. 1, slightly from above.

FIGS. 2 and 4 show the drive motor in enlarged representations. One will recognize there two lateral, perforated guard plates 6 and 7 (only the front guard plate 6 is shown in FIG. 2), which are arranged on each side of the motor 2. These guard plates extend substantially vertically and are fastened on the motor housing at their edge lying in the travel direction in a manner known per se. In FIG. 2 the upper right part of the guard plate 6 is cut away, so that one can see the motor or its accessory components lying therebehind.

Figure 3:
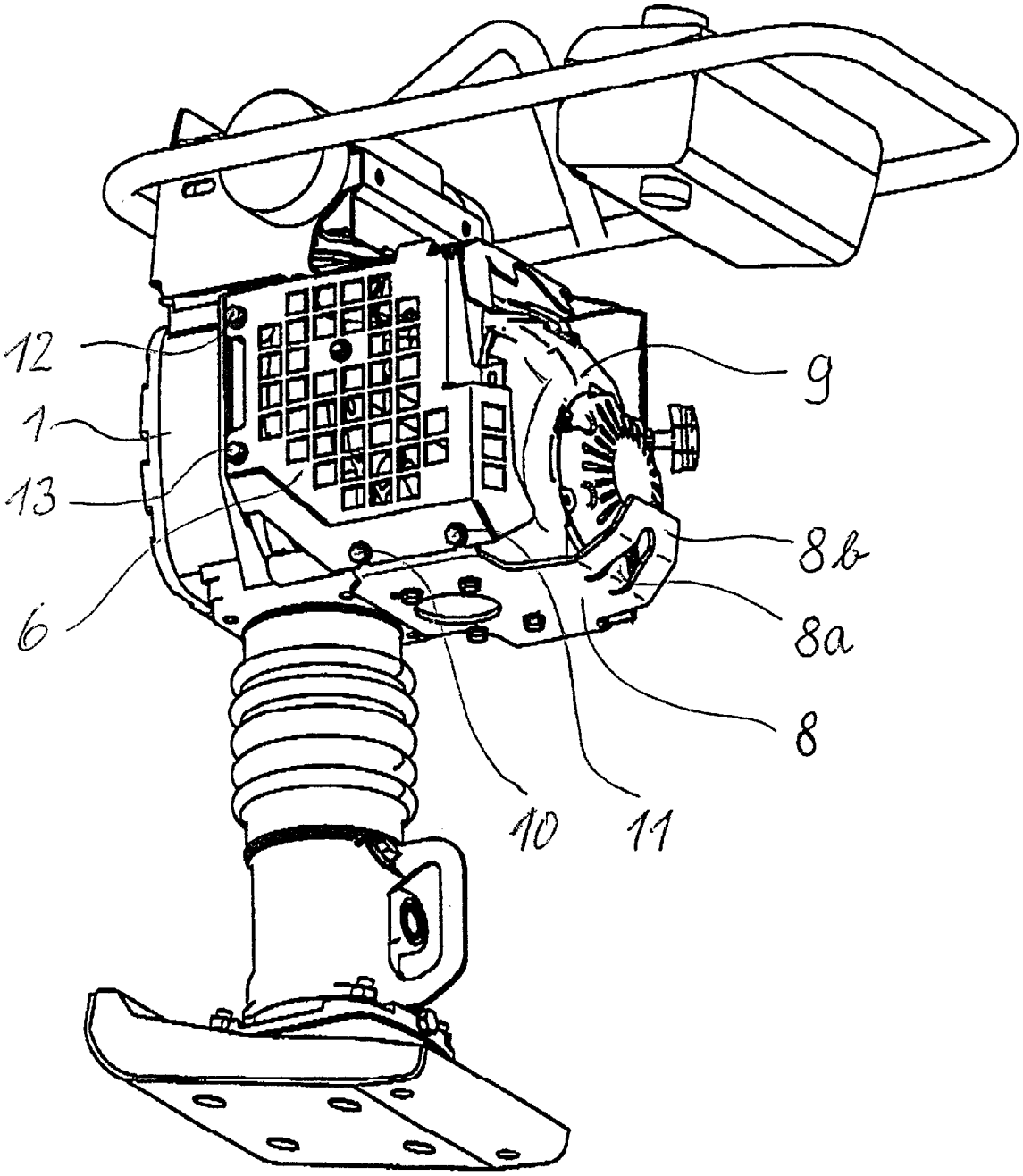
FIG. 3 is an oblique perspective view of the tamper of FIG. 1, slightly from below.

Moreover, one will recognize beneath the drive motor, particularly in FIGS. 2 and 3, a lower or underside guard plate 8, which is screwed onto the motor housing. It is essential that this guard plate, on its free end, be screwed onto the air circulation hood 9 of the motor via an upwardly bent tongue 8*a*. The protruding end 8*b* of the tongue 8*a* of the lower guard plate is likewise bent upwardly and consequently protects the back end of the air circulation hood 9.

It is further essential that the lower guard plate 8 lie with its two lateral edges against the corresponding lower edges of the two lateral guard plates 6 and 7 and be screwed together with these as indicated by reference numbers 10 and 11. For this purpose, in the specified edge regions, borings or elongated holes are provided.

The lower guard plate 8 consists of an approximately 5 mm thick aluminum plate and is screwed firmly on the underside of the drive motor. By the measures described the lower guard plate 8 is fixed extremely stably, and thereby also improves the rigidity of the two lateral guard plates 6 and 7.

In addition, one will recognize in FIGS. 2 and 4 that the lateral guard plates 6 and 7 are extended upwardly above their connection points 12 and 13 on the motor housing and are partially bent inwardly. In this way, they additionally protect in an effective manner the carburetor with its lever bars and the muffler of the drive motor.

FIG. 4 shows an optimization of motor protection, in which each of the two lateral guard plates 6 and 7 is connected on a part of their upper edge with a common cover plate 14 above the motor. The lateral guard plates 6 and 7 are thereby also stabilized in their upper region. At the same time, cover plate 14 protects the motor against contamination from above. Expediently, the cover plate 14 is bent down, at least on the two edges where it is connected with the lateral guard plates 6 and 7, and in these bent down areas it is screwed together with the lateral guard plates.

In sum, the invention is distinguished by an especially effective protection of the motor, wherein a mutual bracing is obtained by the housing-like construction of the various guard plates.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A hand-guided vibration tamper, comprising a tamper foot, a tamper head, and a motor laterally cantilevered on the tamper head) for driving the tamper, wherein the motor has a housing and an air circulation hood and is covered on its under and lateral sides by guard plates, wherein the underside guard plate and the lateral guard plates are connected to the housing, and wherein the underside guard plate is fastened near its free end to the air circulation hood) of the motor.

2. The vibration tamper according to claim 1, wherein the lateral guard plates are screwed together with the underside guard plate.

3. The vibration tamper according to claim 1, wherein the underside guard plate comprises a thick-walled aluminum plate.

4. The vibration tamper according to claim 1, wherein the underside guard plate is bent up on both sides.

5. The vibration tamper according to claim 1, wherein the underside guard plate has an extension beyond the air circulation hood and protects the air circulation hood with this extension.

6. The vibration tamper according to claim 1, wherein the lateral guard plates are connected in their upper regions with a common upper covering for the motor.

7. The vibration tamper according to claim 6, wherein the upper covering is substantially closed.

8. The vibration tamper according to claim 6, wherein the upper covering has at least partially bent down side edges.

9. The vibration tamper according to claim 1, wherein said motor further comprises a carburetor and/or a muffler and wherein at least one of the lateral guard plates extends up to a level of the carburetor and/or the muffler.

10. The vibration tamper according to claim 9, wherein the one lateral guard plate protects operating elements for the carburetor.

11. The vibration tamper according to claim 1, wherein the underside guard plate is fastened to the air circulation hood via an upwardly bent tongue.

12. A method for compacting earth or other material utilizing a hand-guided vibration tamper, comprising:

compacting earth or other material utilizing a vibration tamper comprising a tamper foot, a tamper head, and a motor laterally cantilevered on the tamper head for driving the tamper, wherein the motor has a housing and an air circulation hood and is covered on its under and lateral sides by guard plates, wherein the underside guard plate and the lateral guard plates are connected to the housing, and wherein the underside guard plate is fastened near its free end to the air circulation hood of the motor; and protecting the motor and it components from contacting debris during operation via the lateral side guard plates and the underside guard plate.

13. A hand-guided vibration tamper, comprising:

means for compacting earth or other material comprising a tamper foot, a tamper head, and a motor laterally cantilevered on the tamper head for driving the tamper, wherein the motor has a housing and an air circulation hood and is covered on its under and lateral sides by guard plates, wherein the underside guard plate and the lateral guard plates are connected to the housing, and wherein the underside guard plate is fastened near its free end to the air circulation hood of the motor; and means for protecting the motor and it components from contacting debris during operation via the lateral side guard plates and the underside guard plate.

* * * * *

UNITED STATES PATENT AND TRADEMARK OFFICE

CERTIFICATE OF CORRECTION

PATENT NO. : 6,698,531 B2
DATED : March 2, 2004
INVENTOR(S) : Hans-Werner Kurten It is certified that error appears in the above-identified patent and that said Letters Patent is hereby corrected as shown below:

Column 3,
Line 40, delete “)”.
Line 45, delete “)”.

Signed and Sealed this

Twenty-fifth Day of May, 2004

JON W. DUDAS
*Acting Director of the United States Patent and Trademark Office*